US010641579B2

(12) United States Patent
Xie

(10) Patent No.: US 10,641,579 B2
(45) Date of Patent: May 5, 2020

(54) PROJECTILE TOY

(71) Applicant: GUANGZHOU LINGDONG CREATIVE CULTURE TECHNOLOGY CO., LTD., Guangzhou, Guangdong (CN)

(72) Inventor: Guohua Xie, Guangdong (CN)

(73) Assignee: Guangzhou Lingdong Creative Culture Technology Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 16/465,968

(22) PCT Filed: Mar. 16, 2018

(86) PCT No.: PCT/CN2018/079212
§ 371 (c)(1),
(2) Date: May 31, 2019

(87) PCT Pub. No.: WO2019/169654
PCT Pub. Date: Sep. 12, 2019

(65) Prior Publication Data

US 2020/0080815 A1 Mar. 12, 2020

(30) Foreign Application Priority Data

Mar. 5, 2018 (CN) ..... 2018 1 0179052

(51) Int. Cl.
*A63H 1/02* (2006.01)
*F41B 7/08* (2006.01)
(Continued)

(52) U.S. Cl.
CPC ..... *F41B 7/08* (2013.01); *A63H 1/02* (2013.01); *A63H 31/00* (2013.01); *A63H 33/009* (2013.01)

(58) Field of Classification Search
CPC ..... A63H 1/02; F41B 7/08
See application file for complete search history.

(56) References Cited

U.S. PATENT DOCUMENTS 1,060,612 A * 5/1913 Mangelsdorff ..... A63H 1/02 446/260
1,133,756 A * 3/1915 Smith ..... A63H 1/02 446/260

(Continued)

FOREIGN PATENT DOCUMENTS

CN 87205664 U 7/1988
CN 2218016 Y 1/1996

(Continued)

*Primary Examiner* — John A Ricci
(74) *Attorney, Agent, or Firm* — Muncy, Geissler, Olds & Lowe, P.C.

(57) ABSTRACT

A projectile toy is provided, which includes a projected base, a driving mechanism arranged on the projected base, a rotating body, a triggering mechanism and a projected mechanism. The driving mechanism drives said rotating body to rotate for energy storage. The triggering mechanism triggers the projected mechanism to push the rotating body after energy storage out of the projected base. The projectile toy is reasonable in structural design and has a function of projecting, and the projected rotating body can also perform rotational motions, thereby expanding interestingness and functionality of toys.

8 Claims, 2 Drawing Sheets

(51) Int. Cl.
*A63H 33/00* (2006.01)
*A63H 31/00* (2006.01)

(56) References Cited

U.S. PATENT DOCUMENTS

| | | | | | |
|---|---|---|---|---|---|
| 1,959,635 | A | | 5/1934 | Moore | |
| 2,188,824 | A | * | 1/1940 | Thigpen | A63H 1/02 446/260 |
| 2,375,986 | A | * | 5/1945 | Gandy | A63H 1/02 446/259 |
| 4,867,728 | A | * | 9/1989 | Moomaw | A63H 1/02 446/259 |
| 2014/0326228 | A1 | | 11/2014 | Poirier | |

FOREIGN PATENT DOCUMENTS

| | | | |
|---|---|---|---|
| CN | 2642381 | Y | 9/2004 |
| CN | 202762073 | U | 3/2013 |
| CN | 203605801 | U | 5/2014 |
| CN | 204165450 | U | 2/2015 |
| CN | 104436666 | A | 3/2015 |
| CN | 204219756 | U | 3/2015 |
| CN | 208059683 | U | 11/2018 |
| EP | 2 899 490 | A1 | 7/2015 |
| FR | 760308 | A | 2/1934 |
| GB | 411923 | A | 6/1934 |
| JP | 2004-129829 | A | 4/2004 |

* cited by examiner

PROJECTILE TOY

FIELD OF TECHNOLOGY

The present invention relates to the technical field of toys, in particular to a projectile toy.

BACKGROUND

Toys are important tools for children's cognitive development and for entertainment. Meanwhile, along with continuous improvement of living standards, the pursuit of quality and function of toys has also become higher.

For the existing toys, along with a pursuit for intelligence development activities, interestingness of toys should also be increased, so as to improve interest of children. By virtue of unique special effects, animation films in daily life have attracted a large crowd of fans, while many toys derived from animation films are deeply welcomed by fans. Wherein due to their relatively rough workmanship and low simulation degree, or due to their only function of projectiles, the existing projectile toys thus cannot satisfy modern people's pursuits of multiple playing methods of toys.

In addition, the existing projectile toys generally can only be played in one single method, and can only eject projectiles in a single way, with no other novel playing method being available, thereby lacking interestingness. In addition, since the appearance of existing projectile toys is traditional and lacks novelty, the existing projectile toys have difficulty in acquiring long-term affection of children; therefore children easily lose interest and gradually lay such toys aside.

SUMMARY

An aspect relates to a projectile toy, which is reasonable in structural design and has a function of projecting, and a projected rotating body can also perform rotational motions, thereby expanding interestingness and functionality of toys.

The projectile toy includes a projected base, a driving mechanism arranged on the projected base, a rotating body, a triggering mechanism and a projected mechanism; wherein the driving mechanism drives the rotating body to rotate for energy storage, and the triggering mechanism triggers the projected mechanism to push the rotating body after energy storage out of the projected base.

Therefore, for the projectile toy in the present invention, a projected base is taken as a foundation for projection and energy storage, and a driving mechanism arranged on the projected base drives a rotating body to rotate for energy storage, and a triggering mechanism triggers a projected mechanism to push the rotating body after energy storage out of the projected base, such that not only the toy has a projecting function, but also the projected rotating body can perform rotational motions, thereby expanding functionality of the toy. In addition, the projectile toy in the present invention has reasonable structural design, extremely high interestingness and entertainment, thereby possessing high marketing values.

In order to obtain better technical effects, further technical improvements also include: the driving mechanism includes a driving box and driving components arranged in the driving box. The driving components include a long tooth piece, an active gear, a transmission gear, a sliding gear, and a driving gear; wherein the active gear, the transmission gear and the sliding gear are connected in sequence in a driving manner; the long tooth piece penetrates through the driving box and is connected with the active gear in a driving manner; the driving gear is connected with the rotating body in a driving manner; and the driving box is provided with an arc groove, and the sliding gear is arranged in the arc groove in a sliding manner, and is connected with the driving gear in a driving manner or is separated from the driving gear.

In order to obtain better technical effects, further technical improvements also include: a tail end of the long tooth piece is provided with a handheld part, and the long tooth piece is pulled or pushed through the handheld part to drive an active gear to rotate.

In order to obtain better technical effects, further technical improvements also include: the projected mechanism includes a projected piece, two clamping blocks and a projected spring, wherein a front end of the projected piece is provided with a U-shaped groove, two sides of the U-shaped groove are respectively symmetrically provided with clamping holes, the two clamping blocks are respectively arranged on the clamping holes at two sides of the U-shaped groove in a movable manner, and the rotating body is clamped between two clamping blocks in a movable manner; and a rear end of the projected piece is provided with a jacking pillar, and the projected spring is sleeved on the jacking pillar.

In order to obtain better technical effects, further technical improvements also include: a limited block extends downwards from the bottom of a rear end of the projected piece.

In order to obtain better technical effects, further technical improvements also include: the triggering mechanism includes an expansion piece and a compression piece, wherein a top end of the expansion piece is provided with a locking piece matched with the projected mechanism, and the expansion piece is connected with a projected base through an expansion spring arranged at the bottom; a square through hole is arranged in the middle of the expansion piece, an incline plane is arranged at the bottom of the square through hole, one end of the compression piece penetrates through the square through hole and the compression piece is arranged on the projected base through a compressed spring, and a jacking block which is matched with the incline plane of the square through hole is arranged at the position at which the compression piece is connected with the expansion piece.

In order to obtain better technical effects, further technical improvements also include: one end, opposite to the compression piece, of the locking piece is an oblique plane, and one end, back to the compression piece, of the locking piece is a right angle.

In order to obtain better technical effects, further technical improvements also include: the projected base is in a shape of a gun body.

In order to obtain better technical effects, further technical improvements also include: the rotating body is a spinning top.

BRIEF DESCRIPTION

DETAILED DESCRIPTION

In order to further describe embodiments, accompanying drawings are provided with the present application. These drawings constitute a part of contents disclosed in the present application, which are mainly used for describing embodiments, and can explain operation principles of embodiments in coordination with related description of the specification. With reference to these contents, those skilled in the art should understand other possible embodiments and advantages of the present application.

Figure 1:
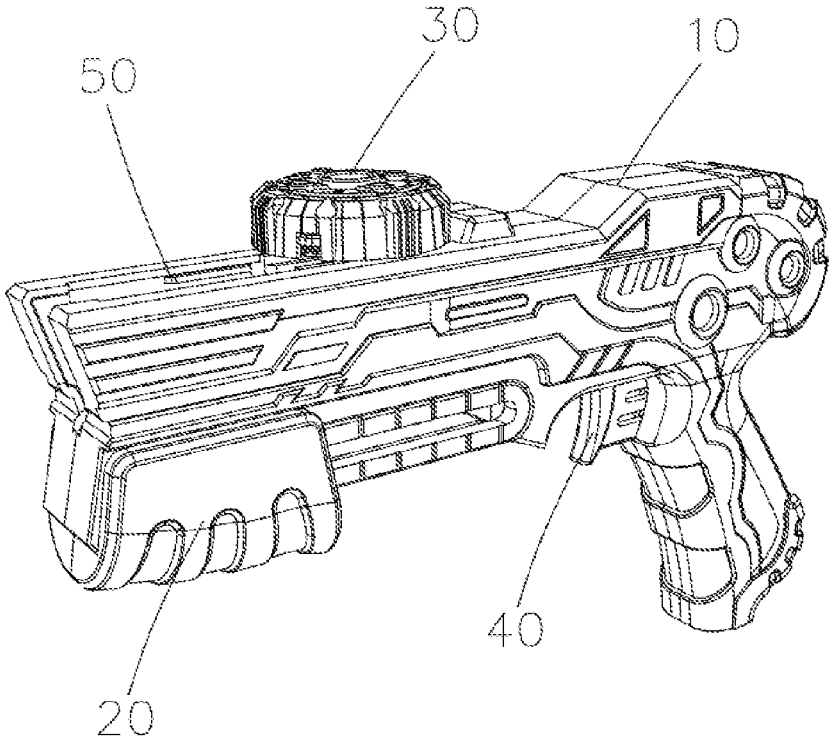
FIG. 1 is a structural schematic diagram of a projectile toy in one or more embodiments of the present application.
Figure 2:
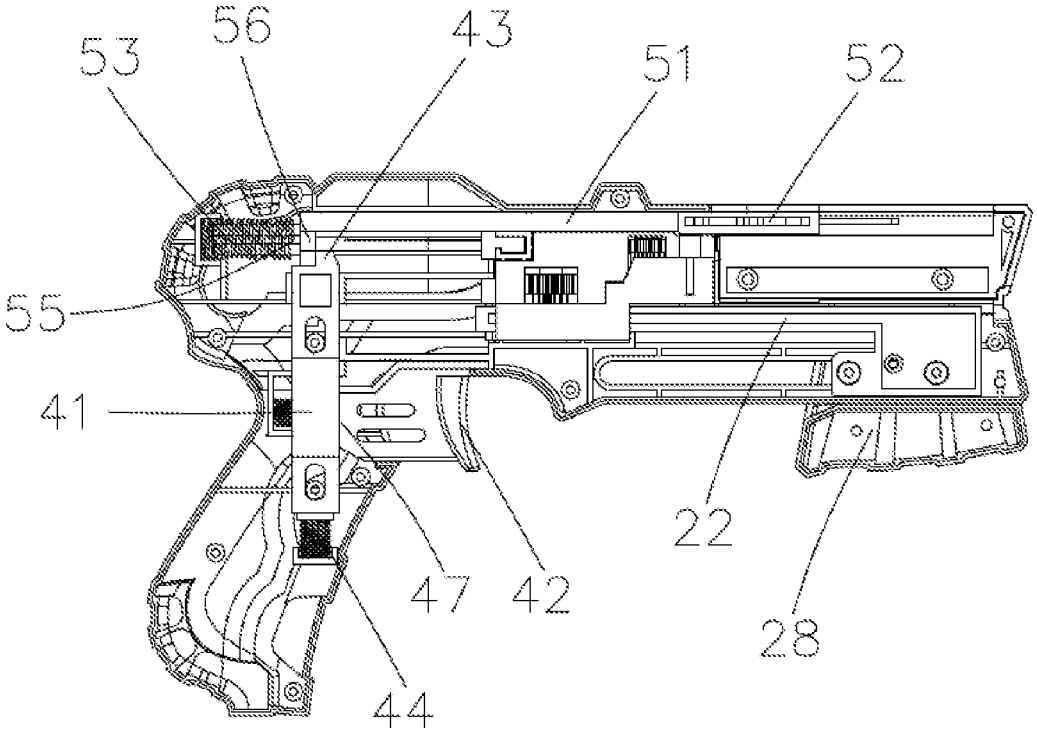
FIG. 2 is a sectional view of a projectile toy in one or more embodiments of the present application.
Figure 3:
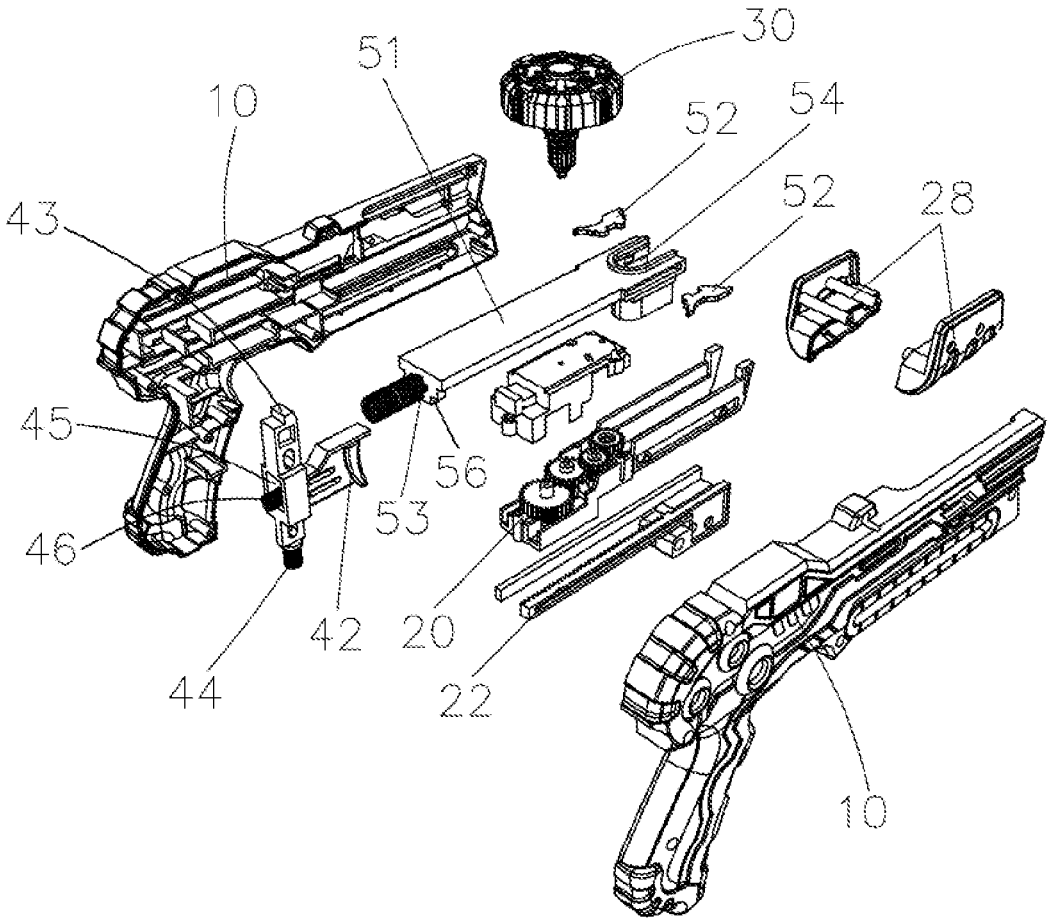
FIG. 3 is a decomposition schematic diagram of a projectile toy of in one or more embodiments of the present application.
Figure 4:
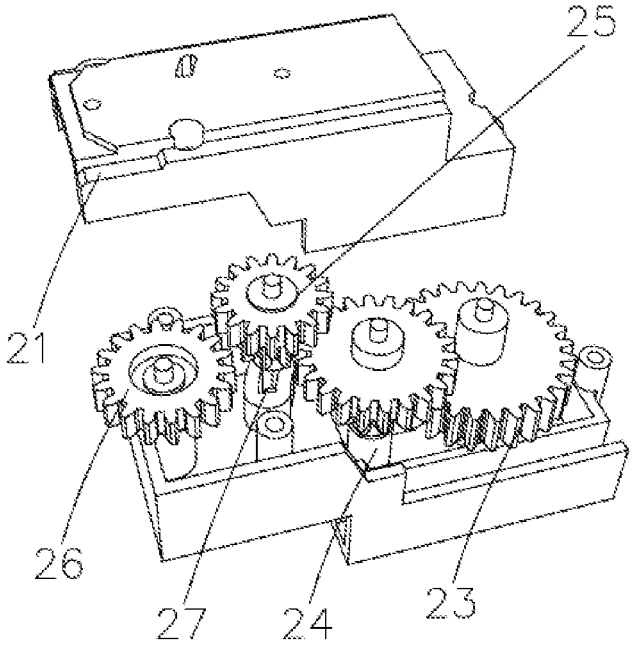
FIG. 4 is a structural schematic diagram of a driving mechanism of a projectile toy in one or more embodiments of the present application.

Please refer to FIG. 1 to FIG. 4 simultaneously.

A projectile toy includes a projected base 10, a driving mechanism 20 arranged on the projected base 10, a rotating body 30, a triggering mechanism 40 and a projected mechanism 50; wherein the driving mechanism 20 drives the rotating body 30 to rotate for energy storage, and the triggering mechanism 40 triggers the projected mechanism 50 to push the rotating body 30 after energy storage out of the projected base 10.

The projected base 10 of the present application can be designed to be of many different projected structures. In order to better describe a projectile toy of the present application, in some embodiments, preferably, the projected base 10 is in a shape of a gun body, which has a projected chamber, a triggering chamber and a driving chamber. Correspondingly, the projected mechanism 50, the triggering mechanism 40 and the driving mechanism 20 are respectively arranged in the projected chamber, the triggering chamber and the driving chamber.

Specifically, the driving mechanism 20 includes a driving box 21 and a driving component arranged in the driving box 21. The driving component includes a long tooth piece 22, an active gear 23, a transmission gear 24, a sliding gear 25, and a driving gear 26; wherein the active gear 23, the transmission gear 24 and the sliding gear 25 are connected in sequence in a driving manner; the long tooth piece 22 penetrates through the driving box 21 and is connected with the active gear 23 in a driving manner; the driving gear 26 is connected with the rotating body 30 in a driving manner; and the driving box 21 is provided with an arc groove 27, and the sliding gear 25 is arranged in the arc groove 27 in a sliding manner, and is connected with the driving gear 26 in a driving manner or is separated from the driving gear 26.

Further, a tail end of the long tooth piece 22 is provided with a handheld part 28, and the long tooth piece 22 is pulled or pushed through the handheld part 28 to drive the active gear 23 to rotate, thereby driving other gears to rotate in sequence and driving the rotating body 30 to rotate.

In addition, the projected mechanism 50 includes a projected piece 51, two clamping blocks 52 and a projected spring 53, wherein a front end of the projected piece 51 is provided with a U-shaped groove 54, two sides of the U-shaped groove 54 are respectively symmetrically provided with clamping holes, the two clamping blocks 52 are respectively arranged on the clamping holes at the two sides of the U-shaped groove 54 in a movable manner, and the rotating body 30 is clamped between the two clamping blocks 52 in a movable manner; a rear end of the projected piece 51 is provided with a jacking pillar 55, and the projected spring 53 is sleeved on the jacking pillar 55. Wherein a tail end of the jacking pillar 55 is pressed in the projected base 10, and in coordination with the U-shaped groove 54 at the front end of the projected piece 51, a front end of the projected base 10 is provided with a U-shaped track, so as to ensure that the rotating body 30 can be projected out smoothly.

Preferably, a limited block 56 extends downwards from the bottom of a rear end of the projected piece 51. In addition, the two clamping blocks 52 are arranged above the driving gear 26, such that the middle part of the rotating body 30 is clamped between the two clamping blocks 52 and a lower end of the rotating body 30 is connected with the driving gear 26 in a driving manner.

In addition, the triggering mechanism 40 includes an expansion piece 41 and a compression piece 42, wherein a top end of the expansion piece 41 is provided with a locking piece 43 matched with the projected mechanism 50, and the expansion piece 41 is connected with the projected base 10 through an expansion spring 44 arranged at the bottom; a square through hole 45 is arranged in the middle of the expansion piece 41, an incline plane is arranged at the bottom of the square through hole 45, one end of the compression piece 42 penetrates through the square through hole 45 and is arranged on the projected base 10 through a compressed spring 46, and a jacking block 47 which is matched with the incline plane of the square through hole 45 is arranged at a position at which the compression piece 42 is connected with the expansion piece 41.

Wherein one end, opposite to the compression piece 42, of the locking piece 43 is an oblique plane, and one end, back to the compression piece 42, of the locking piece 43 has is a right angle. The projected mechanism 50 and the triggering mechanism 40 are coupled to each other by a matching connection of the locking piece 43 and the limited block 56.

The rotating body 30 is sleeved at the front end of a projected piece 51 through the U-shaped groove 54, and is clamped between the two clamping blocks 52 in a movable manner. Wherein, preferably, the rotating body 30 is a spinning top.

Working principles of a projectile toy of the present application are described below:

Firstly, the rotating body 30 is clamped between the two clamping blocks 52 in a movable manner, the projected piece 51 presses backwards firmly into the projected spring 53, such that the limited block 56 at the lower part of the projected piece 51 is clamped onto the locking piece 43 at the top end of the expansion piece 41, and then the long tooth piece 22 is pushed towards a direction of the triggering mechanism 40 through the handheld part 28 to drive the active gear 23 to rotate. At this time, since a rotation direction of the active gear 23 is clockwise, such that a rotation direction of the transmission gear 24 is anticlockwise, and a rotation direction of the sliding gear 25 is clockwise, and then the sliding gear 25 slides to one end, close to the driving gear 26, of an arc groove 27, at this time, the sliding gear 25 and the driving gear 26 are connected in a driving manner, so as to drive the rotating body 30 to rotate. When the handheld part 28 pulls backwards, since the rotation directions of corresponding gears are all reversed, then the rotation direction of the sliding gear 25 is anticlockwise, such that the sliding gear 25 slides to one end, far away from the driving gear 26, of the arc groove 27, and at this time, the sliding gear 25 is separated from the driving gear 26, so as to prevent the driving gear 26 from driving the rotating body 30 to rotate in an opposite direction. Then the long tooth piece 22 is pulled and pushed repeatedly, such that the rotating body 30 continuously rotates for energy storage. When energy is stored for a certain degree, the compression piece 42 is held back backwards, such that the compression piece 42 drives the expansion piece 41 to move downwards, and then the locking piece 43 at the top end of the expansion piece 41 is separated from the limited block 56 at the lower part of the projected piece 51. At this time, under the effect of the projected spring 53, the projected piece 51 projects forwards and projects out the rotating body 30 by utilizing the effect of an inertia force, while the rotating body 30 at this time has finished storing energy, and performs rotational motions after being projected out.

Wherein, the projected direction of the rotating body 30 and rotational energy of the rotating body 30 can both be adjusted according to different requirements.

Compared with the known art for the projectile toy in the present application, a projected base is taken as a foundation for projection and energy storage, and a driving mechanism arranged on the projected base drives a rotating body to rotate for energy storage, a triggering mechanism triggers a projected mechanism to push the rotating body after energy storage out of the projected base, such that not only the toy has a projecting function, but also the projected rotating body can perform rotational motions, thereby expanding functionality of the toy. In addition, the projectile toy in the present application has reasonable structural design, extremely high interestingness and entertainment, thereby possessing high marketing values.

The above embodiments merely express several implementations of the present invention, and the description is relatively specific and detailed, however, it cannot be understood as a limitation to the scope of the present invention patent. It should be noted that, for those skilled in the art, under the premise of not departing from the conception of the present invention, numerous transformations and improvements can also be made, and these transformations and improvements shall all fall within the protection scope of the present invention.

What is claimed:

1. A projectile toy comprising:

a projected base;

a driving mechanism arranged on the projected base;

a rotating body;

a triggering mechanism; and a projected mechanism;

wherein the driving mechanism drives the rotating body to rotate for energy storage, and the triggering mechanism triggers the projected mechanism to push the rotating body after energy storage out of the projected base; and the driving mechanism comprises:

a driving box; and a driving component arranged in the driving box, comprising a long tooth piece, an active gear, a transmission gear, a sliding gear, and a driving gear; wherein the active gear, the transmission gear and the sliding gear are connected in sequence in a driving manner; the long tooth piece penetrates through the driving box and is connected with the active gear in a driving manner; the driving gear is connected with the rotating body in a driving manner; and the driving box has an arc groove, and the sliding gear is arranged in the arc groove in a sliding manner, and is connected with the driving gear in a driving manner or is separated from the driving gear.

2. The projectile toy of claim 1, wherein a tail end of the long tooth piece is provided with a handheld part, and the long tooth piece is pulled or pushed through the handheld part to drive the active gear to rotate.

3. The projectile toy of claim 1, wherein the projected mechanism comprises:

a projected piece, a front end of the projected piece has a U-shaped groove, two sides of the U-shaped groove are respectively symmetrically provided with clamping holes, and a rear end of the projected piece is provided with a jacking pillar;

two clamping blocks, respectively arranged on the clamping holes at the two sides of the U-shaped groove in a movable manner, and the rotating body is clamped between the two clamping blocks in a movable manner; and a projected spring sleeved on the jacking pillar.

4. The projectile toy of claim 3, wherein a limited block extends downwards from the bottom of the rear end of the projected piece.

5. The projectile toy of claim 1, wherein the triggering mechanism comprises:

an expansion piece, a top end of the expansion piece has a locking piece matched with the projected mechanism, and the expansion piece is connected with a projected base through an expansion spring arranged at the bottom, a square through hole is arranged in the middle of the expansion piece, and an incline plane is arranged at the bottom of the square through hole; and a compression piece, one end of the compression piece penetrates through the square through hole, the compression piece is arranged on the projected base through a compressed spring, and a jacking block matched with the incline plane of the square through hole, is arranged at a position at which the compression piece is connected with the expansion piece.

6. The projectile toy of claim 5, wherein one end, opposite to the compression piece, of the locking piece is an oblique plane, and one end, back to the compression piece, of the locking piece is a right angle.

7. The projectile toy of claim 1, wherein the projected base is in a shape of a gun body.

8. The projectile toy of claim 7, wherein the rotating body is a spinning top.

* * * * *